US011459136B2

(12) United States Patent
Dai

(10) Patent No.: US 11,459,136 B2
(45) Date of Patent: Oct. 4, 2022

(54) INTELLIGENT VACUUM PACKAGING APPARATUS AND METHOD

(71) Applicant: Sun Ling Packing Machinery Co., Ltd., Douliu (TW)

(72) Inventor: Jhih-Jhan Dai, Douliu (TW)

(73) Assignee: Sun Ling Packaging Machinery Co., Ltd., Douliu (TW)

( * ) Notice: Subject to any disclaimer, the term of this patent is extended or adjusted under 35 U.S.C. 154(b) by 11 days.

(21) Appl. No.: 17/321,618

(22) Filed: May 17, 2021

(65) Prior Publication Data

US 2021/0380291 A1 Dec. 9, 2021

(30) Foreign Application Priority Data

Jun. 5, 2020 (TW) ..... 109119049

(51) Int. Cl.
*B65B 31/02* (2006.01)
*B65B 57/00* (2006.01)
*B65B 51/10* (2006.01)

(52) U.S. Cl.
CPC ..... *B65B 31/024* (2013.01); *B65B 51/10* (2013.01); *B65B 57/00* (2013.01)

(58) Field of Classification Search
None
See application file for complete search history.

(56) References Cited

U.S. PATENT DOCUMENTS

2005/0022471 A1* 2/2005 Higer ..... F04B 49/022 53/512
2019/0055042 A1* 2/2019 Leppert ..... B29C 65/20
2020/0283178 A1* 9/2020 Liang ..... B65B 31/06

FOREIGN PATENT DOCUMENTS

CN 107934010 A * 4/2018 ..... B65B 31/024
EP 3115303 A1 * 1/2017 ..... B65B 31/024
WO WO-2013029558 A1 * 3/2013 ..... B65B 31/024
WO WO-2019013714 A1 * 1/2019

* cited by examiner

*Primary Examiner* — Hemant Desai
*Assistant Examiner* — Tanzim Imam
(74) *Attorney, Agent, or Firm* — Karin L. Williams; Alan D. Kamrath; Mayer & Williams PC

(57) ABSTRACT

A vacuum packing apparatus includes a box, a lid, a solenoid, a vacuum pump, a pressure gauge, a time relay, a thermal sealer and a controller. The box includes a chamber. The lid is connected to the box. The thermal sealer is located in the chamber. The controller is electrically connected to the vacuum pump, the solenoid, the thermal sealer and the time relay. The panel is electrically connected to the controller.

5 Claims, 7 Drawing Sheets

INTELLIGENT VACUUM PACKAGING APPARATUS AND METHOD

BACKGROUND OF INVENTION

1. Field of Invention

The present invention relates to a vacuum packing apparatus and method and, more particularly, to an intelligent internally-pumping vacuum packing apparatus and method.

2. Related Prior Art

Packing apparatuses are often used to pack food and required to generate high degrees of vacuum or low values of pressure. There are internally-pumping vacuum packing apparatuses and externally-pumping vacuum packing apparatuses. An internally pumping vacuum packing apparatus includes a vacuum chamber in which air is pumped from a packing material such as a bag before the bag is sealed. An externally-pumping vacuum packing apparatus includes a pipe which is inserted into a bag to pump air from the bag before the bag is sealed.

To operate an internally-pumping vacuum packing apparatus, at first, a bag that contains a product is located in a vacuum chamber before the vacuum chamber is closed. Then, a vacuum pump is used to pump air from the vacuum chamber and hence from the bag. On the moment when the pressure in the vacuum chamber reaches an intended value, the vacuum pump is turned off. Then, a thermal sealer is used to seal the bag. Then, air is admitted into the vacuum chamber. The difference in pressure between the interior and exterior of the bag causes the bag to shrink and tightly pack or wrap the product.

A critical factor to cause the pressure in the vacuum chamber to reach the intended value is the operative period of the vacuum pump. The operative period is controlled by a time relay operated by a professional person. The professional person figures out the optimal operative period by trial and error.

However, a lot of time and electricity and lots of bags and products are consumed and the internally pumping vacuum packing apparatus is worn before the optimal operative period is figured out. Such consumption and wearing increase the cost of the packing. Moreover, it requires a professional personal to operate the internally-pumping vacuum packing apparatus and this reduces the packing efficiency and usage rate of the internally-pumping vacuum packing apparatus.

The present invention is therefore intended to obviate or at least alleviate the problems encountered in the prior art.

SUMMARY OF INVENTION

It is the primary objective of the present invention to provide an intelligent vacuum packing apparatus.

To achieve the foregoing objective, the vacuum packing method comprising the step of providing a vacuum packing apparatus. The vacuum packing apparatus includes a box, a lid, a solenoid, a vacuum pump, a pressure gauge, a time relay, a thermal sealer and a controller. The box includes a chamber. The lid is connected to the box. The thermal sealer is located in the chamber. The controller is electrically connected to the vacuum pump, the solenoid, the thermal sealer and the time relay. The panel is electrically connected to the controller. Then, a to-be-packed object is located in a packing material. A portion of the packing material is located in thermal sealer in the chamber. The lid is used to close the chamber in an air-tight manner. The panel is operated to set an intended value. The controller is used to execute the steps of actuating the pressure gauge to detect the pressure in the chamber, actuating the vacuum pump to reduce the pressure in the chamber, calculating a first phase for the pressure to drop to a transient value from an original value, calculating a rate of change in the pressure detected by the pressure gauge in the first phase, calculating a second phase for the pressure to drop to the intended value from the transient value, calculating a total pumping period by adding the first and second phases, calculating a remaining period by deducting time elapsed since the beginning of the suction from the total pumping period, instructing the time relay to turn off the vacuum pump after the remaining period, instructing the thermal sealer to seal the to-be-packed object after the time relay turns off the vacuum pump, and actuating the solenoid to open the chamber to admit air into the chamber.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
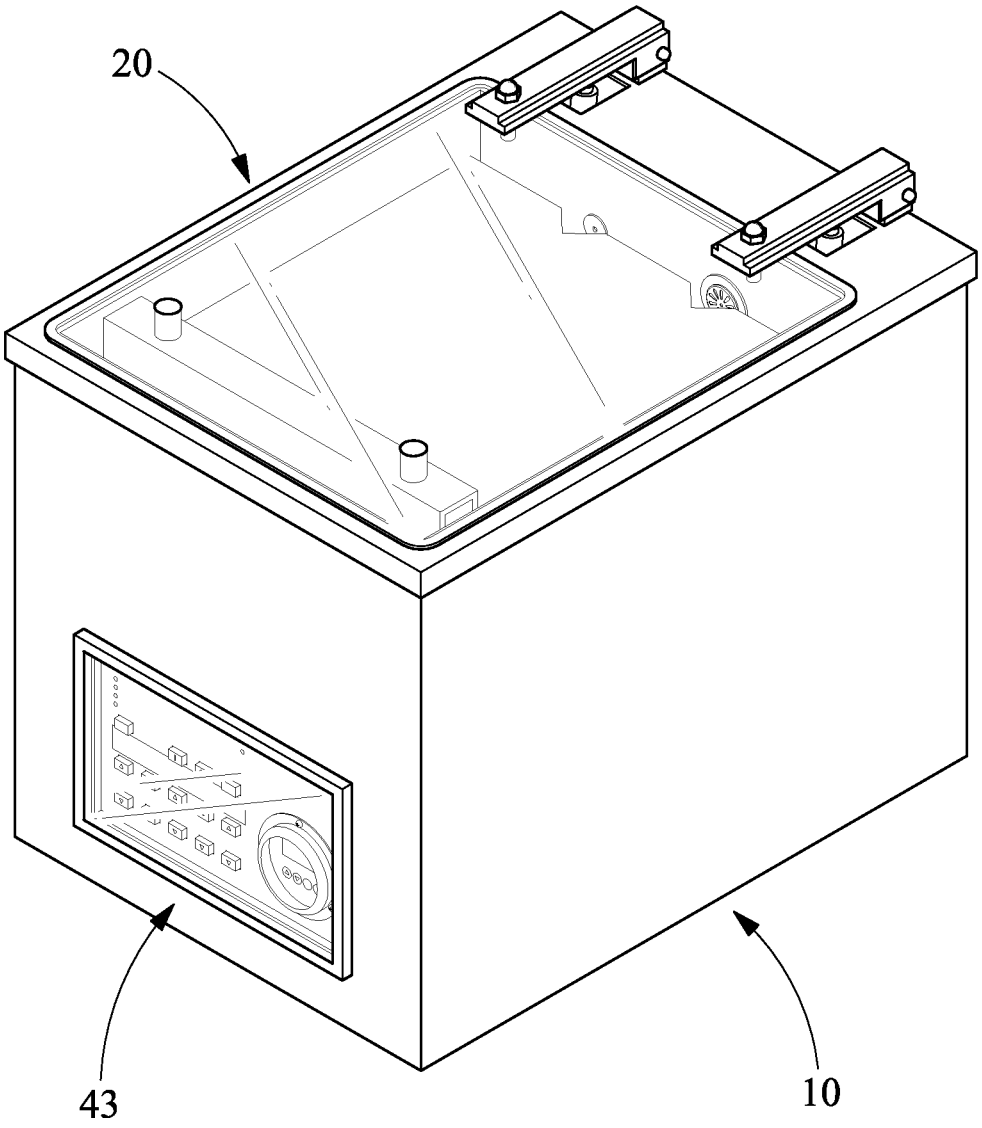
FIG. 1 is a perspective view of an intelligent vacuum packing apparatus according to the preferred embodiment of the present invention.
Figure 2:
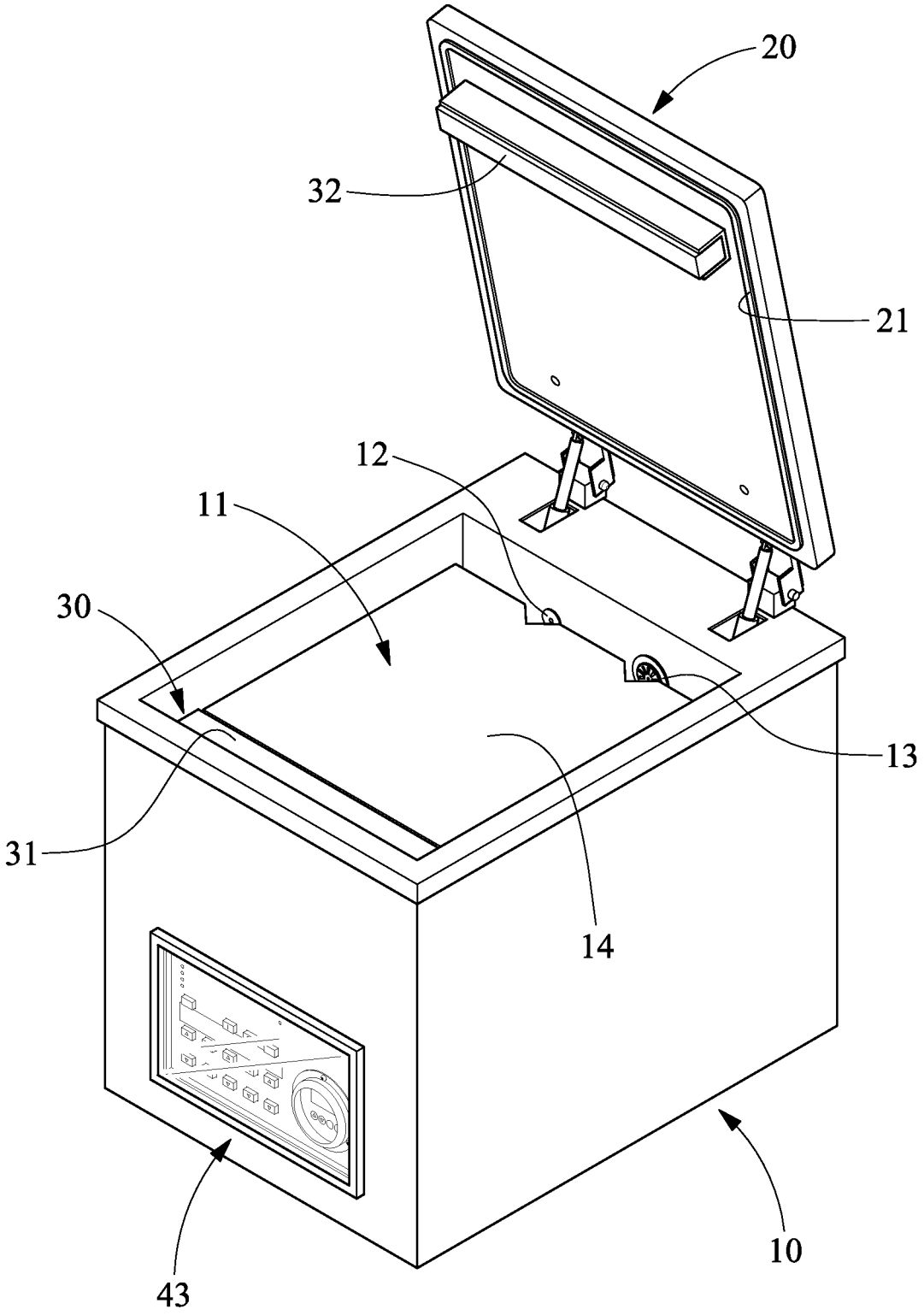
FIG. 2 is a perspective view of the intelligent vacuum packing apparatus shown in FIG. 1 in an open position.
Figure 3:
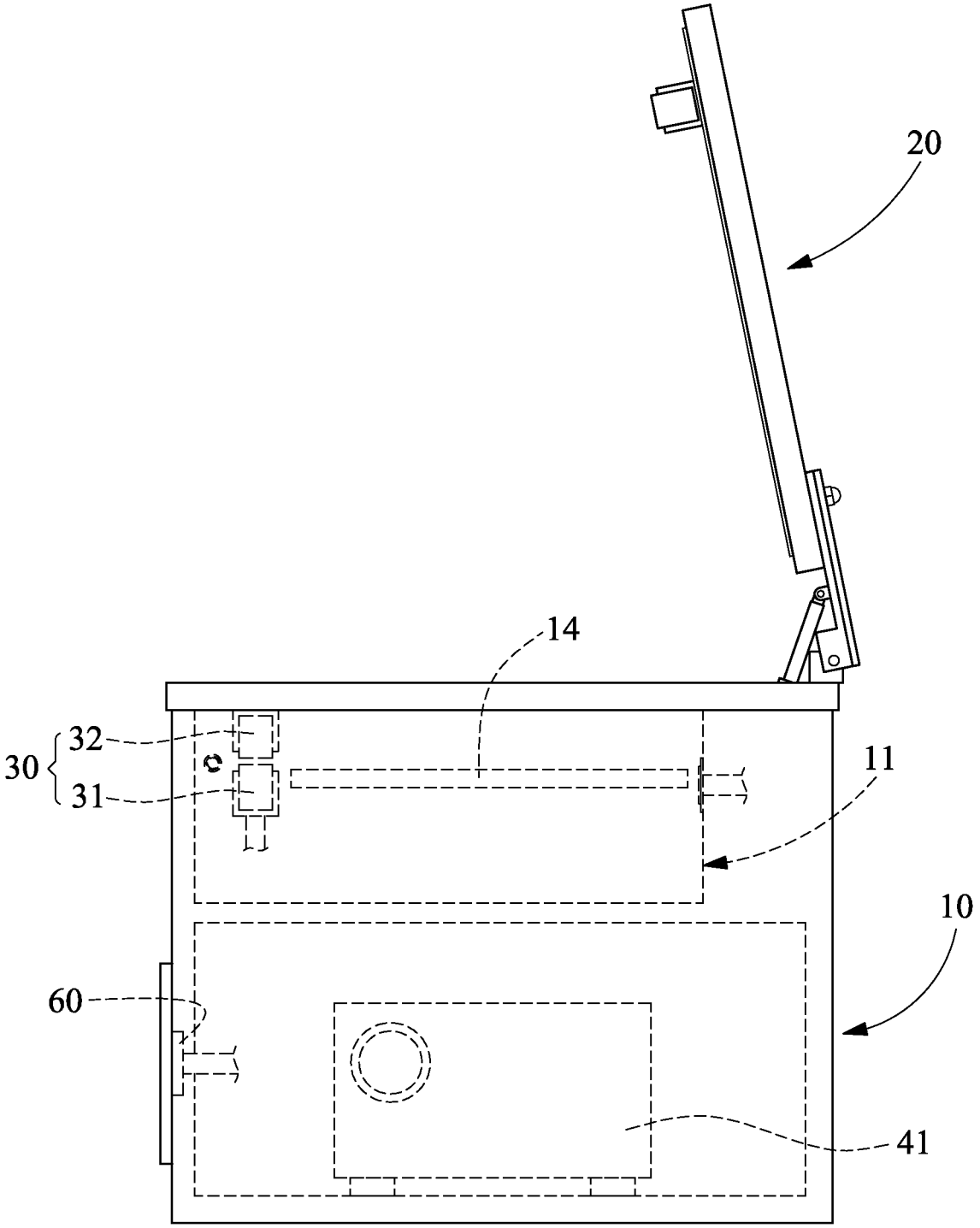
FIG. 3 is a side view of the intelligent vacuum packing apparatus shown in FIG. 2.
Figure 4:
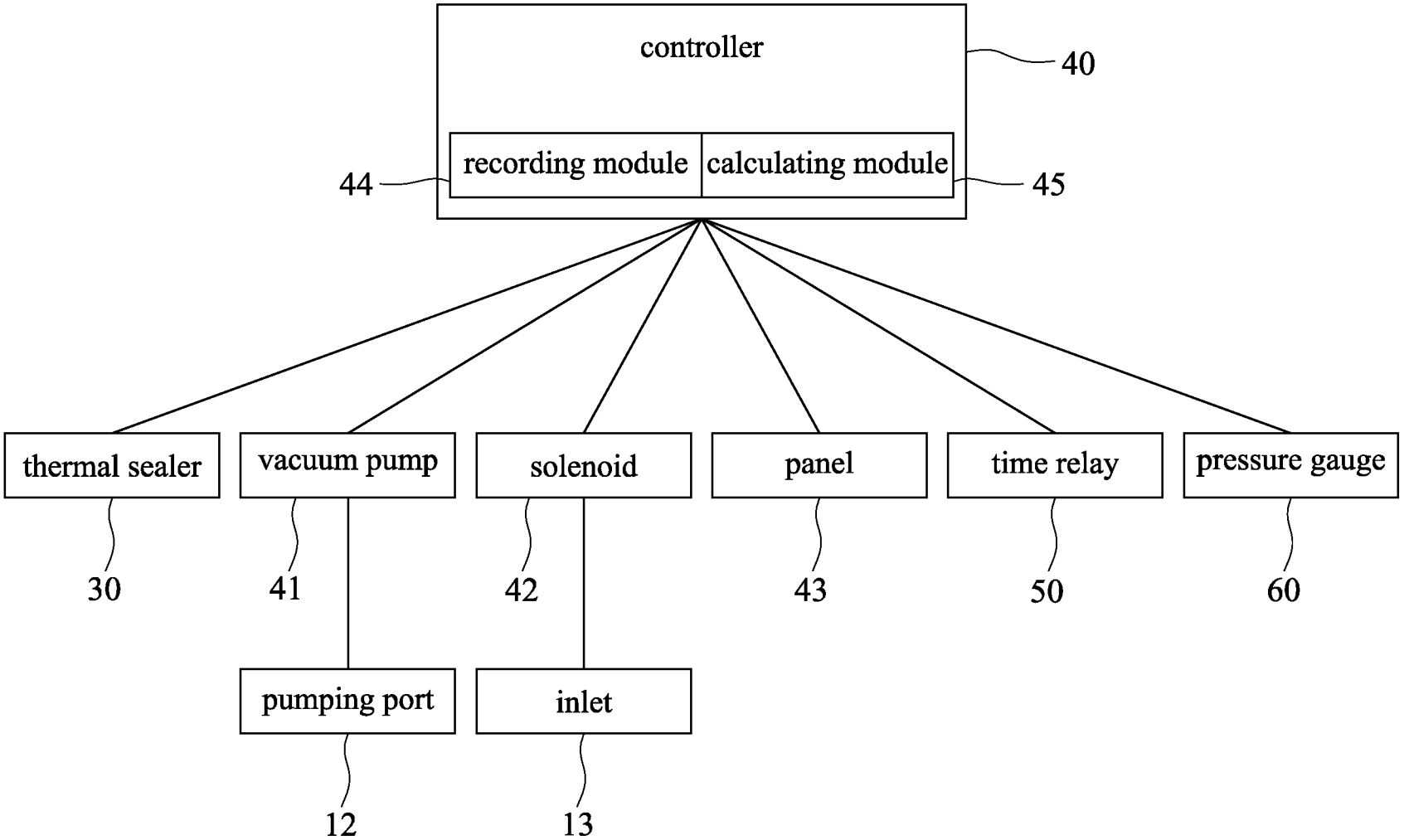
FIG. 4 is a block diagram of the intelligent vacuum packing apparatus shown in FIG. 1.

Referring to FIGS. 1 to 4, an intelligent vacuum packing apparatus includes a box 10, a lid 20, a thermal sealer 30, a controller 40, a vacuum pump 41, a solenoid 42, a time relay 50, and a pressure gauge 60 in accordance with the preferred embodiment of the present invention. The box 10 includes a chamber 11, a pumping port 12 in communication with the chamber 11, an inlet 13 in communication with the chamber 11, and an open upper end (not numbered) in communication with the chamber 11.

A platform 14 is located in the chamber 11. The platform 14 can be lifted and lowered.

The vacuum pump 41 is located in the box 10. The vacuum pump 41 is in communication with the pumping port 12 via a pipe (not numbered).

Another pipe is used to connect the inlet 13 to the exterior of the box 10. The solenoid 42 is located in the box 10. The solenoid 42 is used to open or close the inlet 13.

The lid 20 is pivotally connected to the box 10 by conventional means. The a seal 21 is attached to a lower face of the lid 20. The seal 21 is shaped and sized corresponding to the open upper end of the box 10. The lid 20 can be located at the open upper end of the box 10 to close the chamber 11. The seal 21 seals the chamber 11.

Thermal sealer 30 includes an electro-thermal sealer 31 and a contact element 32. The electro-thermal sealer 31 is located in the chamber 11. The contact element 32 is connected to the lower face of the lid 20. A portion of the packing material around the open end is located between the electro-thermal sealer 31 and the contact element 32 in use.

The pressure gauge 60 is used to detect the pressure in the chamber 11. The pressure gauge 60 is preferably located in the chamber 11.

The time relay 50 is used to detect and control an operative period of the vacuum pump 41. Preferably, the time relay 50 is located in box 10, out of the chamber 11.

The controller 40 is electrically connected to the vacuum pump 41, the solenoid 42, the thermal sealer 30, the time relay 50 and the pressure gauge 60. The controller 40 is used to instruct, control, command and manage the vacuum pump 41, the solenoid 42, thermal sealer 30, the time relay 50 and the pressure gauge 60.

The controller 40 includes a panel 43, a recording module 44 and a calculating module 45. The panel 43 is supported on the box 10 and operable to set an intended pressure, a sealing pressure and a heating period. The recording module 44 and the calculating module 45 are located in the box 10, preferably out of the chamber 21. The recording module controller 40 records the intended pressure, the sealing pressure and the heating period.

Figure 5:
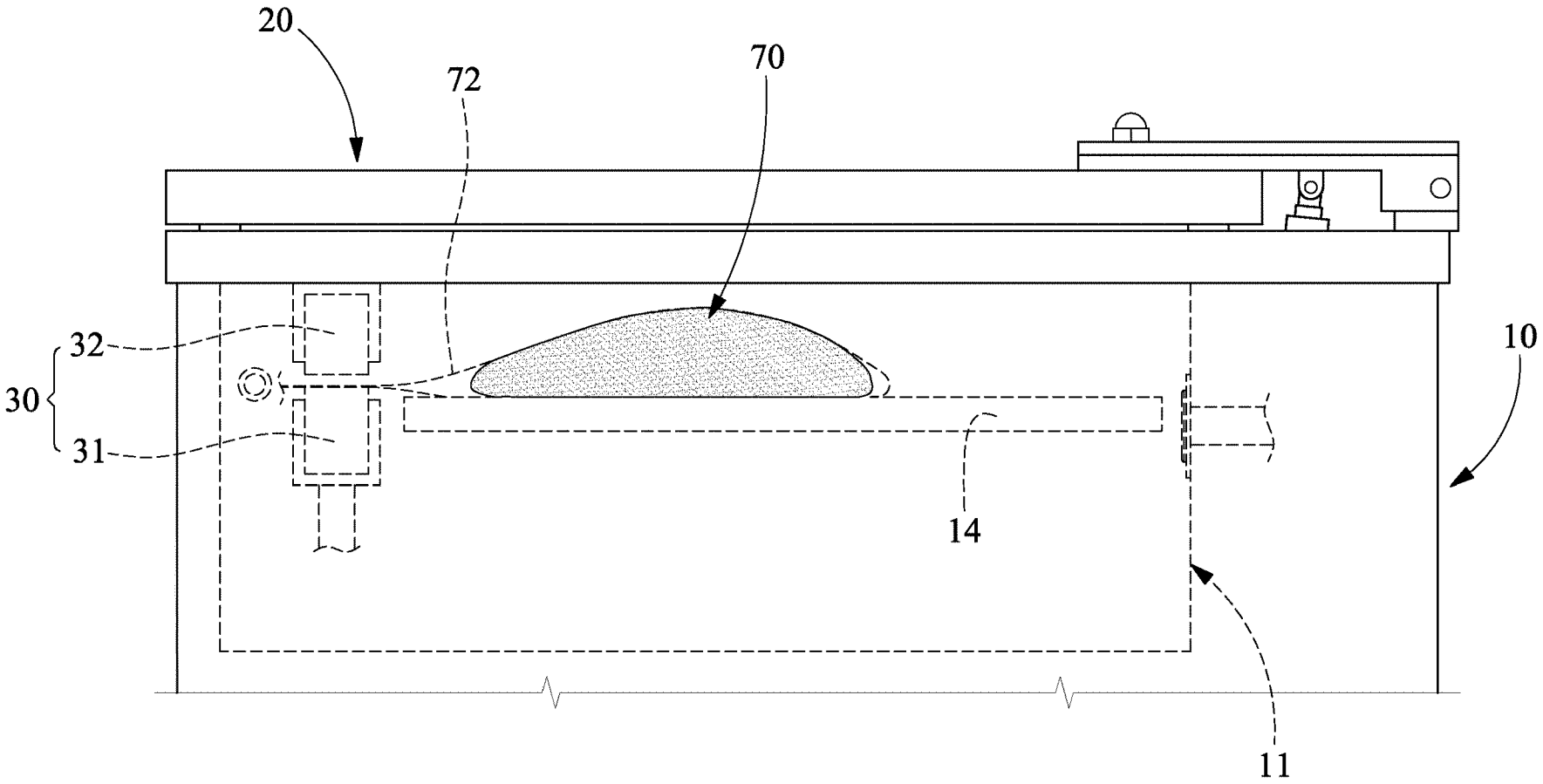
FIG. 5 is an enlarged partial side view of the intelligent vacuum packing apparatus shown in FIG. 1, showing the intelligent vacuum packing apparatus in a first phase of a vacuum sealing task.
Figure 6:
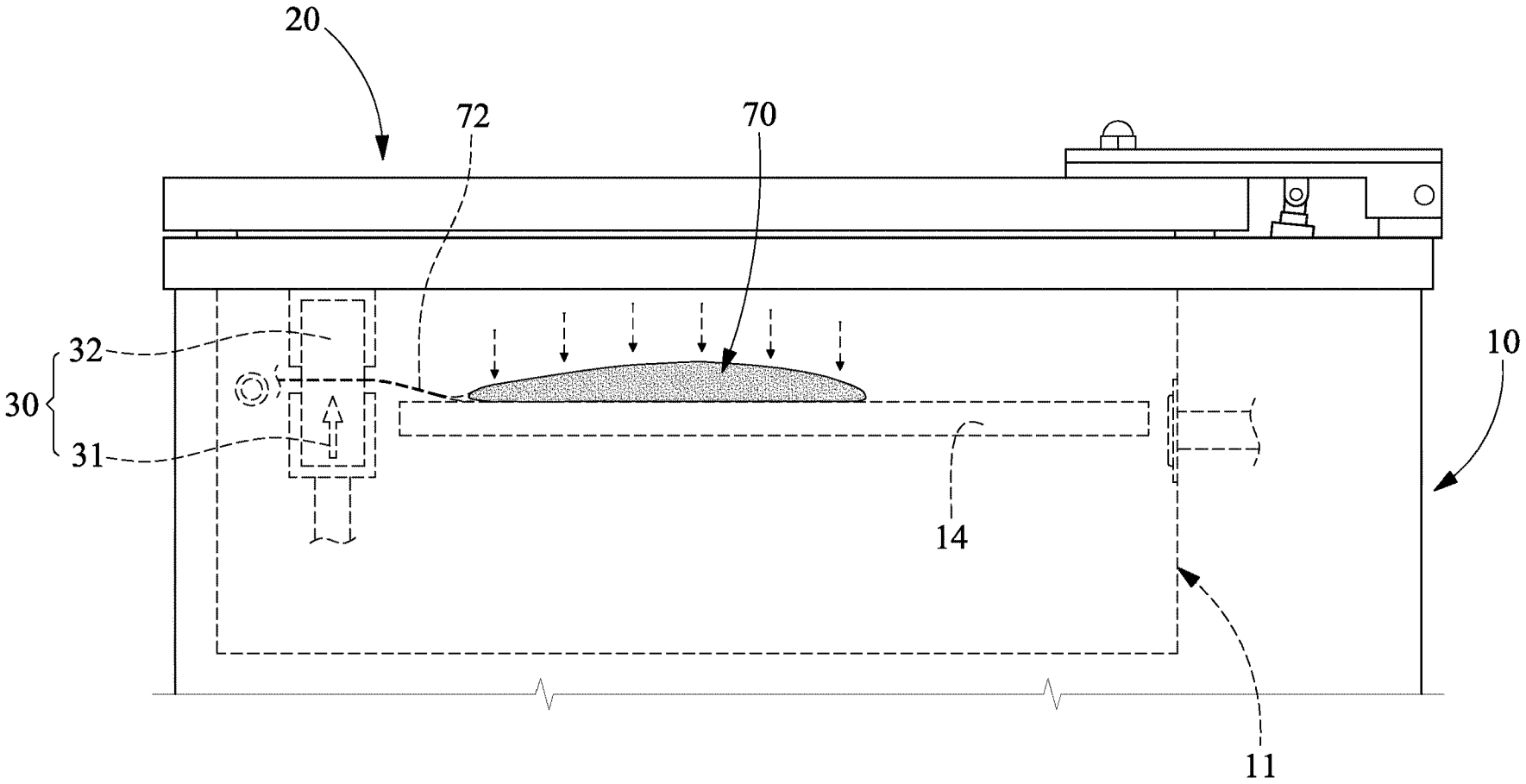
FIG. 6 is an enlarged partial side view of the intelligent vacuum packing apparatus shown in FIG. 1, showing the intelligent vacuum packing apparatus in a second phase of a vacuum sealing task.
Figure 7:
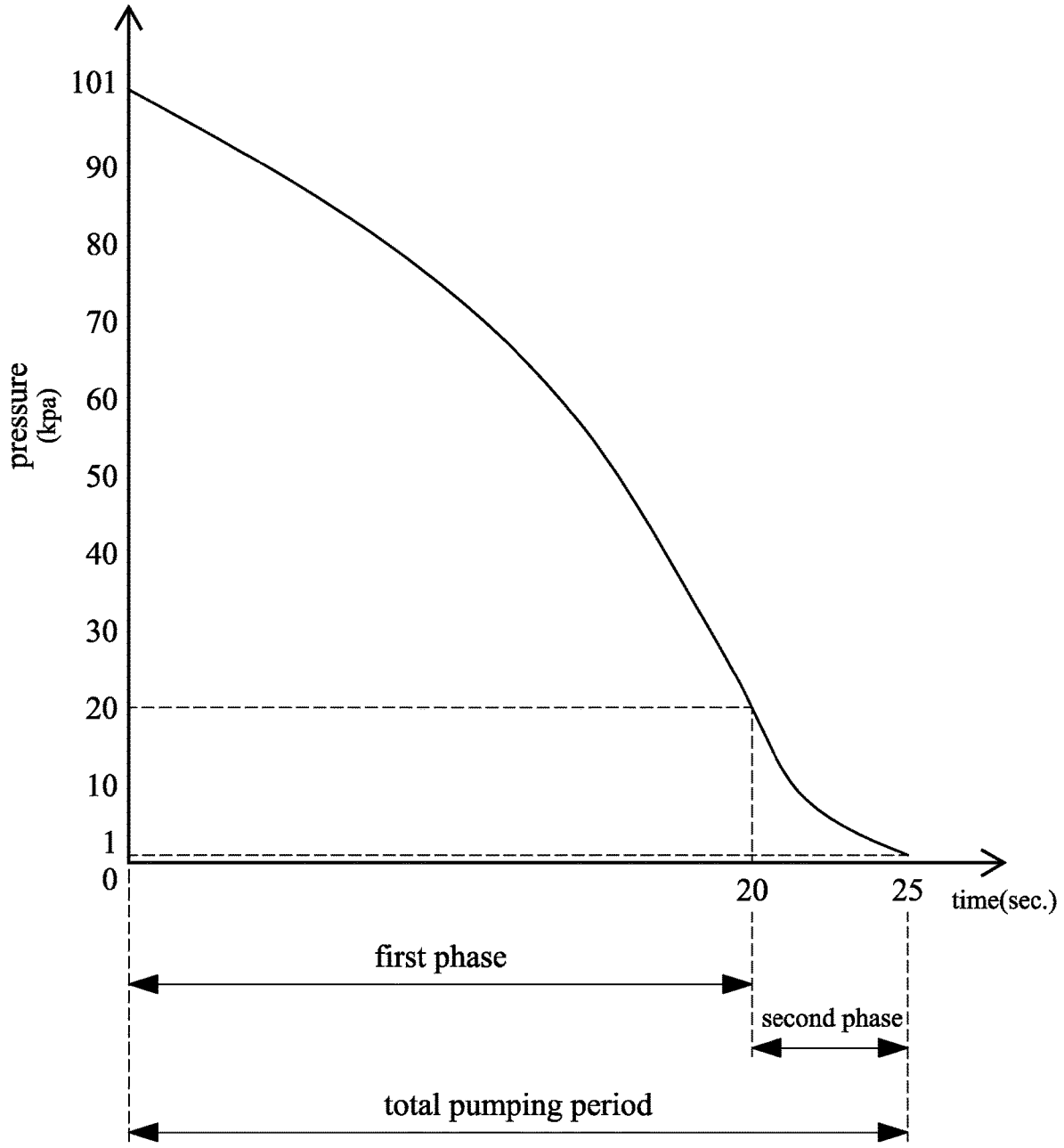
FIG. 7 is a chart of a pressure versus an operative period of the intelligent vacuum packing apparatus shown in FIG. 1.

Referring to FIGS. 5 and 6, a to-be-packed object 70 is located in a packing material 72 such as a plastic bag including an open end. Then, the to-be-packed object 70, which is located in the packing material 72, is located on the platform 14. The elevation of the to-be-packed object 70 is adjustable by lifting or lowering the platform 14. A portion of the packing material 72 around the open end is located between the electro-thermal sealer 31 and the contact element 32 in use. The lid 20 is located on the open upper end of the box 10 and the chamber 11 is sealed by the seal 21. A portion of the packing material 72 around the open end is located between the electro-thermal sealer 31 and the contact element 32.

In operation, the vacuum pump 41 is assumed to operate at a constant average pumping rate. The volume of the chamber 11 is constant, and so are other mechanical factors. Thus, a total pumping period is determined by the volume of the to-be-packed object 70. As the volume of the to-be-packed object 70 gets larger, the total pumping period gets shorter for less air has to be pumped from the chamber 11.

Then, the controller 40 instructs the vacuum packing apparatus to execute a vacuum packing method to reduce the pressure in the chamber 11 to an intended value from an original value. The difference between the intended and original values will be referred to as the "intended difference."

At first, the controller 40 actuates the vacuum pump 41 to pump air from the chamber 11 in two periods. In the first phase, the vacuum pump 41 reduces the pressure in the chamber 11 to a transient value from the original value. The difference between the original and transient values is about 60% to 85% (preferably 80%) of the intended difference. In the second phase, the vacuum pump 41 reduces the pressure to the intended value from the transient value. The difference between the transient and intended values is about 40% to 15% (preferably 20%) of the intended difference.

In the first phase, the pressure gauge 60 continuously detects the pressure in the chamber 11. The controller 40 calculates the rate of the change in the pressure in the chamber 11. Then, based on the rate and the difference between the transient and intended values, the controller 40 calculates the second phase. The sum of the first and second phases is the total pumping period. In practice, it takes some time to calculate the second phase and the total pumping period. The total pumping period minus an eclipsed period (substantially the first phase plus the time used to calculate the second phase and the total pumping period) is a remaining period in which the controller 40 continues to actuate the vacuum pump 41. The controller 40 stops the vacuum pump 41 after the remaining period.

After stopping the vacuum pump 41, the controller 40 immediately instructs the thermal sealer 30 to seal the packing material 72, in which the to-be-packed object 70 is enclosed.

After sealing the packing material 72, the controller 40 immediately actuates the solenoid 42 to open the inlet 13 to admit air into the chamber 11 from the exterior of the chamber 11 via the inlet 13. Now, the difference between the interior and exterior of the packing material 72 causes the packing material 72 tightly packs the to-be-packed object 70.

For example, the intended value of is 1 kpa. The original value will be assumed to be 101 kpa that is about 1 standard atmospheric pressure (101.325 kpa). Hence, the intended difference is 100 kpa. The difference between the original and transient values is set to be 80% of the intended difference, i.e., 80 kpa. Accordingly, the transient value is 21 kpa. The controller 40 actuates the vacuum pump 41 to pump air from the chamber 11 so that it takes 20 seconds (the first phase) for the pressure to drop to 21 kpa from 101 kpa. The pressure gauge 60 detects the pressure continuously. The controller 40 calculates that it takes 5 seconds (the second phase) for the pressure to drop to 1 kpa from 21 kpa. Hence, the total pumping period is 25 (20 plus 5) seconds. It takes about 21 seconds counted from the beginning of the suction for the controller 40 to obtain the total pumping period. The remaining period is 4 (25 minus 21) seconds. Accordingly, the controller 40 commands the time relay 50 to turn off the vacuum pump 41 after 4 seconds.

The recording module 44 records the intended pressure, the first phase, the pressure in the first phase versus time, the second phase and the pump pumping period.

The calculating module 45 executes a program to calculate the rate of change in the pressure in the first phase. Based on the rate of change the pressure in the first phase and the difference between the transient and intended values, the calculating module 45 calculates the second phase. Moreover, the calculating module 45 calculates the total pumping period by adding the second phase to the first phase.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A vacuum packing method comprising the steps of:

providing a vacuum packing apparatus comprising a box (10) comprising a chamber (11), a lid (20) connected to the box (10), a solenoid (42), a vacuum pump (41), a pressure gauge (60), a time relay (50), a thermal sealer (30) located in the chamber (11), a controller (40) electrically connected to the vacuum pump (41), the solenoid (42), thermal sealer (30) and the time relay (50), and a panel (43) electrically connected to the controller (40);

locating a to-be-packed object (70) in a packing material (72);

locating a portion of the packing material (72) in the thermal sealer (30);

using the lid (20) to close the chamber (11) in an air-tight manner;

operating the panel (43) to set an intended value;

using the controller (40) to execute the steps of:

actuating the pressure gauge (60) to detect pressure in the chamber (11);

actuating the vacuum pump (41) to reduce the pressure in the chamber (11);

calculating a first phase for the pressure to drop to a transient value from an original value;

calculating a rate of change in the pressure detected by the pressure gauge (60) in the first phase;

calculating a second phase for the pressure to drop to the intended value from the transient value;

calculating a total pumping period by adding the first and second phases;

calculating a remaining period by deducting time elapsed since the beginning of the pumping from the total pumping period;

instructing the time relay (50) to turn off the vacuum pump (41) after the remaining period;

instructing the thermal sealer (30) to seal the to-be-packed object (70) after the time relay (50) turns off the vacuum pump (41); and actuating the solenoid (42) to open the chamber (11) to admit air into the chamber (11).

2. The vacuum packing method according to claim 1, wherein a difference between the original and transient values is 60% to 85% of a difference between the original and intended values.

3. The vacuum packing method according to claim 2, wherein the difference between the original and transient values is 80% of the difference between the original and intended values.

4. The vacuum packing method according to claim 1, further comprising the step of operating the panel (43) to set a pressure that the thermal sealer (30) exerts on the packing material (72).

5. The vacuum packing method according to claim 1, further comprising the step of operating the panel (43) to set a period for which the thermal sealer (30) seals the packing material (72).

* * * * *